United States Patent [19]

Lacroix

[11] 4,040,429

[45] Aug. 9, 1977

[54] AUTOMATIC APPARATUS FOR MAKING ROLLED CIGARETTES

[76] Inventor: Jean R. Lacroix, 167 bis, Avenue Victor Hugo, 75116 - Paris, France

[21] Appl. No.: 613,540

[22] Filed: Sept. 15, 1975

[30] Foreign Application Priority Data

Nov. 4, 1974 France ..... 74.36611

[51] Int. Cl.[2] ..... A24C 1/10; A24C 5/08

[52] U.S. Cl. ..... 131/51; 131/55

[58] Field of Search ..... 131/55, 47, 48, 49, 131/51

[56] References Cited

U.S. PATENT DOCUMENTS

| | | | |
|---|---|---|---|
| 594,799 | 11/1897 | Huelsmann | 131/51 |
| 2,267,591 | 12/1941 | Karst | 131/51 |
| 3,911,933 | 10/1975 | Crisp et al. | 131/51 X |

FOREIGN PATENT DOCUMENTS

| | | | |
|---|---|---|---|
| 410,605 | 5/1934 | United Kingdom | 131/47 |

*Primary Examiner*—Stephen C. Pellegrino

*Attorney, Agent, or Firm*—Larson, Taylor and Hinds

[57] ABSTRACT

A device for making "rolled" cigarettes comprising a housing containing a plate and a shaft around which an endless belt passes. Slack in the belt forms a groove or cradle between the plate and the shaft and relative movement between the plate and the shaft enables the groove or cradle to be opened and closed. When the groove or cradle is open tobacco may be inserted or a rolled cigarette removed. When the groove or cradle is closed, the belt may be moved relative to the plate by the user to roll the tobacco in the groove in paper or other sheet material.

8 Claims, 4 Drawing Figures

AUTOMATIC APPARATUS FOR MAKING ROLLED CIGARETTES

BACKGROUND OF THE INVENTION

The invention relates to devices for making so-called rolled cigarettes.

A cigarette rolling device which is already known comprises a case inside which two parallel rollers are arranged close to one another, and in which a continuous belt or band encircles the rollers and forms a groove or cradle between the rollers. The groove or cradle is intended to shape the tobacco in the form of a cylinder and the belt can be manipulated to roll a cigarette paper around this cylinder.

In the known machines of this type, one of the rollers is movable between two positions, one position being spaced from the other roller in order to form a wide slot for the introduction of tobacco into the groove, and the other position being close to the other roller to form a narrow slit for the introduction of a cigarette paper.

Rollers are generally used which have a diameter as large as the usual diameter of a finished cigarette, which means that these devices are cumbersome and thick, so that they are visible when carried in the user's pocket, and result in the said pockets losing their shape.

In use, difficulties are experienced with these known devices in manipulating the endless belt so as to form the cylinder of tobacco and roll a cigarette paper therearound, since this belt is caused to move by thumb movements on the generatrices of one of the rollers. For this reason a very small application surface is available on the belt, producing a feed movement which becomes less and less suitable for making a cigarette of uniform, regular shape.

Finally, the known machines are very often fairly complex to manufacture.

It is an object of the invention to avoid the disadvantages of the previous machines, in other words to provide a machine which is not very bulky, is very flat, can be handled easily, and is simple and easy to manufacture.

It is a further object of the invention to provide a device which can be used to make cigarettes of various diameters.

STATEMENT OF THE INVENTION

According to the present invention a device for making rolled cigarettes comprises a housing containing a bearing plate and a bearing shaft, said plate extending in a plane substantially parallel to a base of said housing, an endless belt passing around said plate and said shaft whereby slack in said belt forms a groove for receiving tobacco, said plate and said shaft being relatively movable to open and substantially close said groove, said bearing plate having a major surface serving as a support for said belt whereby, when said groove is substantially closed, a piece of sheet material can be introduced into the groove and an operator can move the belt relative to the plate to roll the tobacco within the sheet material.

Such an arrangement satisfies the conditions as regards a small degree of bulkiness and in addition can be easily manipulated, since in order to drive the belt the operator can act on a large surface with his fingers, in other words can act on the whole surface of the belt which is in contact with the bearing plate.

Conveniently the shaft is stationary and the plate is movable. Guide means may be provided for guiding said movement of said plate between a first position in which said groove is open and can receive tobacco and eject a rolled cigarette and a second position in which said groove is substantially closed.

Preferably, said major surface is provided with notches having edge inclined in the direction of movement of said belt whereby movement of said belt in the opposite direction is resisted.

DESCRIPTION OF THE PREFERRED EMBODIMENT

Figure 1:
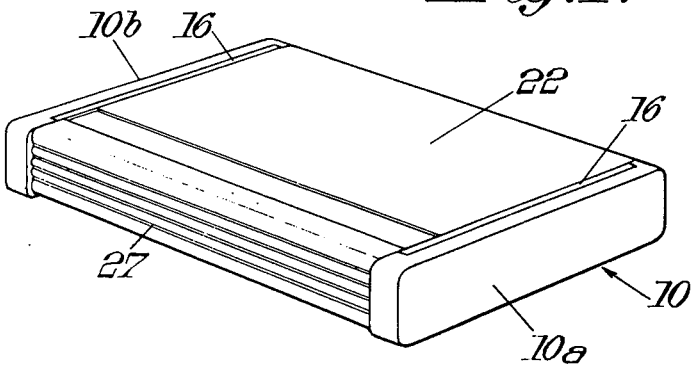
FIG. 1 is a perspective view of a device for making rolled cigarettes, the device being shown with its lid closed.
Figure 2:
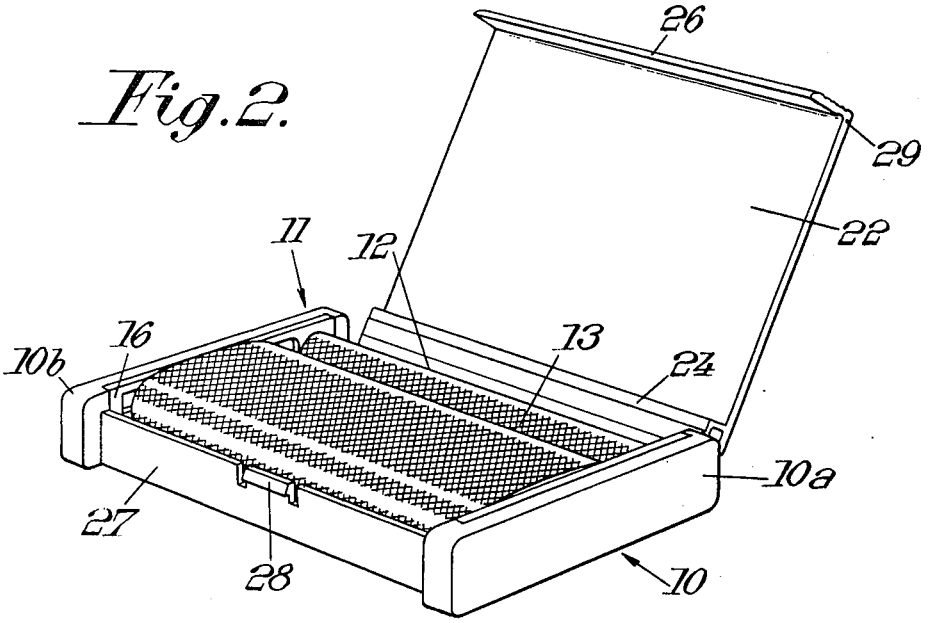
FIG. 2 is a perspective view of the device of FIG. 1 with its lid open.

A device for making rolled cigarettes is indicated generally in FIGS. 1 and 2 by the reference numeral 10.

The device includes a flat case 11 serving as a housing for an endless belt 12 which forms, in one part of its path, a groove or cradle 13 for shaping and forming a cylinder of tobacco and rolling a cigarette paper around the cylinder of tobacco. As can be seen in detail from FIGS. 3 and 4, the crade 13 of the endless belt 12 is defined at one side by a shaft 14 around which the belt 12 passes, and at the other side by one of the edges 15*a* of a parallelepiped plate 15.

The parallelepiped plate is located between a pair of lateral slide grooves 16 in a position substantially parallel to the base 17 of the flat case. The upper surface of the plate forms a support plane enabling the endless belt 12 to be set in motion. It can be seen that with this arrangement the support plane provides a very large bearing surface by means of which the belt can be moved, thus enabling the belt to be moved in a continuous and regular manner.

Figure 3:
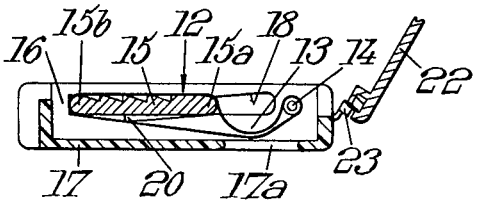
FIG. 3 is a cross-section of the device of FIGS. 1 and 2 with the lid open and the tobacco receiving groove open.
Figure 4:
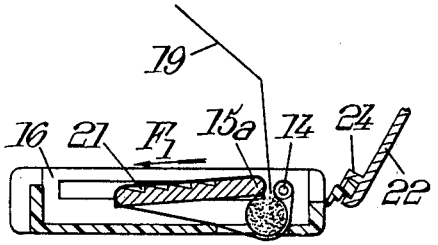
FIG. 4 is a view similar to FIG. 3 with the tobacco receiving groove closed.

The support plate 15 can move in the grooves 16 and is guided by guides 18 between the two end positions shown in FIGS. 3 and 4.

In FIG. 3 the support plate is situated in its position nearest the front of the device so that the groove 13 is open. In this position tobacco can be introduced into the cradle or groove 13, and a finished cigarette can be ejected.

In the position shown in FIG. 4, the plate is situated in its position further from the front of the device so that the groove is closed. This enables a cylinder of tobacco to be formed, a cigarette paper 19 to be introduced into the narrow gap between the bearing roller 14 and the edge 15*a* of the support plate.

In each of the grooves 16, along the guided path of the support plate, there is a member 20 forming a stop for the edge 15*b* of the support plate. When the groove is closed the edge 15*b* of the plate abuts the stop and thus retains the plate in this position.

The parallelepiped plate 5 has notches 21 on its upper surface forming the support plane. The edges of these notches are inclined in the direction of motion of the endless belt, shown by the arrow F in FIG. 4. The movement of the endless belt is facilitated by this arrangement, while movement of the belt in the opposite direction is resisted by the notches.

In order to simplify the construction and assembly of the device, the bearing shaft 14, the support plate 15 and the slide grooves 16 form a unit which is inserted in the housing between lateral surfaces 10*a*, 10*b*. When positioned within the housing the upper edges of the grooves 16 are level with the upper edges of the lateral sides 10*a*, 10*b*.

It should be noted that the guide track of the grooves 16 is formed by a transverse guide 18 so that the lateral extremities of the support plate 15 are guided in the lateral direction by the internal faces of the lateral walls 10*a*, 10*b* of the flat case.

The base 17 of the flat case has a window 17*a* level with the position of the cradle, so that the belt, as shown in FIG. 4, can pass through this window, thus enabling the total thickness of the device to be reduced.

The flat case of the device is closed by a lid 22 which is connected to the flat case by means of a shaped hinge 23, which is moulded integrally with the case when the latter is made of plastics material in accordance with an advantageous embodiment of the invention. According to this embodiment the shaped hinge 23 engages a channel 24 in the lid 22 which channel 24 has a shape which corresponds with that of the hinge 23 and is provided on both sides of the lid.

Thus, when the lid is closed, it is flush with the flat case, which helps to reduce the thickness of the device. The lid 22 has a downwardly projecting edge 26 at the opposite end to the hinge 23, which in the closed position just fits over a side 27 of the flat case. In the closed position the downwardly projecting edge 26 of the lid 22 fits between the forwardly projecting ends of the lateral walls 10*a*, 10*b*. Thus, in the closed state the lid does not project beyond the general outline of the case. However, to assist in opening the lid, the latter is provided with gripping ridges on the external surface of the downwardly projecting edge 26. The edge 27 of the flat case is provided with a clasp 28 having a tooth which, when the lid is closed, engages a groove 29 provided in the internal face of the downwardly projecting edge 26 of the lid.

Cigarettes of different diameters may be obtained using the device described above. The braking action of the stationary shaft on the endless belt ensures that the diameter of the cigarette obtained corresponds to the amount of tobacco introduced into the groove.

The stationary shaft advantageously comprises means (grooves, channels, knurled sections) to increase its coefficient of friction with respect to the endless belt.

In another embodiment of the invention the parallelepiped plate 15 may be stationary, while the shaft 14 is movably mounted in a slide groove.

Various modifications may be made to the embodiment described without departing from the scope and spirit of the invention.

I claim:

1. A device for making rolled cigarettes comprising a housing containing a bearing plate and a bearing shaft, said plate extending in a plane substantially parallel to a base of said housing, an endless belt passing around said plate and said shaft whereby slack in said belt forms a groove between said plate and said shaft for receiving tobacco, means mounting at least one of said plate and said shaft for relative movement to open and substantially close said groove, said bearing plate having a major surface serving as a support for said belt in a manually accessible position whereby, when said groove is substantially closed, a piece of sheet material can be introduced into the groove and an operator can manually move the belt along said major surface relative to the plate and hence around said shaft to roll the tobacco within the sheet material.

2. The device of claim 1 wherein said bearing shaft is stationary and said plate is movable, and wherein guide means are provided for guiding said movement of said plate between a first position in which said groove is open and can receive tobacco and eject a rolled cigarette and a second position in which said groove is substantially closed.

3. The device of claim 2 wherein said bearing shaft, said plate and said guide means form a unit situated between two opposing side walls of the housing.

4. The device of claim 2 including stop means preventing movement of the plate from the second to the first position to enable the operator to move the belt relative to the plate to form the cigarette.

5. The device of claim 1 wherein said major surface is provided with notches having edges inclined in the direction of movement of said belt whereby movement of said belt in the opposite direction is resisted.

6. The device of claim 1 wherein the plate is stationary and the shaft is movable in order to open and close the groove, and wherein means are provided for maintaining the shaft in the position in which the groove is closed during movement of the belt relative to the plate.

7. The device of claim 1 wherein the bearing shaft comprises means for increasing its coefficient of friction with the endless belt.

8. The device of claim 1 wherein a window is provided in said base of said housing, said window being positioned to receive a part of said groove when said groove is substantially closed.

* * * * *